US012605645B2

(12) United States Patent
Aneja

(10) Patent No.: US 12,605,645 B2
(45) Date of Patent: Apr. 21, 2026

(54) PARTICULATE DISPENSING DEVICE AND ASSOCIATED METHOD

(71) Applicant: Neil Aneja, Roanoke, VA (US)

(72) Inventor: Neil Aneja, Roanoke, VA (US)

( * ) Notice: Subject to any disclaimer, the term of this patent is extended or adjusted under 35 U.S.C. 154(b) by 238 days.

(21) Appl. No.: 18/392,451

(22) Filed: Dec. 21, 2023

(65) Prior Publication Data

US 2024/0207754 A1 Jun. 27, 2024

Related U.S. Application Data

(60) Provisional application No. 63/434,259, filed on Dec. 21, 2022.

(51) Int. Cl.
*A63H 37/00* (2006.01)

(52) U.S. Cl.
CPC ..... *A63H 37/00* (2013.01)

(58) Field of Classification Search
CPC ..... A63H 37/00
USPC ..... 446/475; 124/16, 37
See application file for complete search history.

(56) References Cited

U.S. PATENT DOCUMENTS 5,015,211 A * 5/1991 Reveen ..... A63H 37/00 446/475
5,149,290 A * 9/1992 Reveen ..... A63H 37/00 446/475
5,597,160 A * 1/1997 Mims ..... A63B 69/407 124/16
5,803,791 A * 9/1998 Chiles ..... A63H 37/00 124/1
5,954,563 A * 9/1999 Spriggs ..... F42B 4/22 102/357
6,450,160 B1 * 9/2002 Fu ..... F41B 11/00 124/63
6,468,126 B1 * 10/2002 Herber ..... A63H 37/00 472/51
6,572,435 B1 * 6/2003 Wong ..... A63H 37/00 124/16
6,669,530 B2 * 12/2003 Du ..... A63H 37/00 124/16
7,350,477 B1 * 4/2008 Tilford ..... A23G 3/28 118/308

(Continued)

FOREIGN PATENT DOCUMENTS

CN 2820264 Y * 9/2006
CN 2870938 Y * 2/2007

(Continued)

*Primary Examiner* — Alexander R Niconovich
(74) *Attorney, Agent, or Firm* — Dickinson Wright PLLC

(57) ABSTRACT

A particulate dispensing device includes a tube. A base is located in the tube near a bottom end. A rod is axially moveable in the tube. The rod has an annular stopper. A plurality of radially moveable securement tabs are coupled to the base. A piston is slideable along the rod. The piston has a lower end that has an annular recess. A spring biases the piston upwardly. In a stored position, the rod is pressed downwardly with a top lid such that the stopper moves the securement tabs into the annular recess to secure the piston. A top lid is removable to permit movement of the stopper of the rod away from the securement tabs to remove the securement tabs from the annular recess to permit the piston to move via the spring to project a particulate from the tube.

6 Claims, 5 Drawing Sheets

(56) References Cited

U.S. PATENT DOCUMENTS

| | | | | |
|---|---|---|---|---|
| 8,469,011 | B2 * | 6/2013 | Mroczka | F42B 27/00 124/16 |
| 9,044,686 | B2 * | 6/2015 | Aguila | F41B 7/08 |
| 9,352,244 | B2 * | 5/2016 | Aguila | F41B 7/00 |
| 10,898,824 | B1 * | 1/2021 | Meno | A63H 37/00 |
| 2001/0053654 | A1 * | 12/2001 | Watkins | A63H 37/00 446/475 |
| 2002/0077027 | A1 * | 6/2002 | Wu | A63H 37/00 446/475 |
| 2007/0298647 | A1 * | 12/2007 | Lee | A63F 9/0204 439/354 |
| 2019/0046893 | A1 * | 2/2019 | Ming | A63H 37/00 |
| 2021/0016198 | A1 * | 1/2021 | Meno | A63H 37/00 |
| 2022/0126219 | A1 * | 4/2022 | Howie | A21C 15/002 |

FOREIGN PATENT DOCUMENTS

| | | | | |
|---|---|---|---|---|
| FR | 3031681 | A1 * | 7/2016 | A63H 37/00 |
| GB | 2573989 | A * | 11/2019 | A63H 37/00 |
| GB | 2576037 | A * | 2/2020 | A63H 5/00 |
| KR | 920003929 | Y1 * | 6/1992 | A63H 29/04 |

* cited by examiner

PARTICULATE DISPENSING DEVICE AND ASSOCIATED METHOD

CROSS-REFERENCE TO RELATED APPLICATIONS

This application claims the benefit of and priority to U.S. Provisional Patent Application Ser. No. 63/434,259, filed on Dec. 21, 2022, the entire disclosure of which is incorporated herein by reference.

FIELD

The present disclosure relates to amusement devices. More particularly, the present disclosure relates to a device for dispensing a particulate such as confetti, and methods of using such a device.

BACKGROUND

This section provides background information related to the present disclosure which is not necessarily prior art.

Prank devices have long been known for eliciting amusement by surprising unsuspecting users. Traditional prank devices range from discreet sound and smell emitters to devices for dispensing materials like water and confetti. There remains room in the art for new and exciting prank devices.

SUMMARY

This section provides a general summary of the disclosure and is not intended to be interpreted as a comprehensive listing of its full scope or of all of its objects, aspects, features and/or advantages.

According to an aspect of the disclosure, a particulate dispensing device includes an elongated tube that extends along an axis between a bottom end and a top end. The tube defines a bore along the axis. A top lid removeably closes the top end of the tube. A base is located in the bore of the tube adjacent to the bottom end. A rod is axially moveable in the tube and extends between the base and the top end. The rod defines an annular stopper that extends radially outwardly. A plurality of securement tabs are coupled to the base. The securement tabs are each radially moveable relative to the fitting. A piston is slideable along the rod in the bore of the tube. The piston has a lower end that is tube-shaped and has an annular recess that extends radially outwardly. A spring is located inside the bore of the tube and is biased toward the top of the piston. In a stored position, the rod is pressed downwardly with the top lid such that the stopper of the rod engages the plurality of securement tabs and moves the radial tabs radially outwardly into engagement with the annular recess of the piston to secure the piston in place axially and to hold the spring in place in its biased state. The top lid is removable to a released position to free the rod to permit movement of the stopper of the rod out of alignment with the securement tabs to remove the securement tabs from the annular recess to permit the piston to slide axially along the rod in response to unloading of the spring. A particulate is contained in the tube between the piston and the top lid for being emitted from the tube in response to removal of the top lid and axial movement of the piston.

According to another aspect of the disclosure, a method for operating a particulate dispensing device includes providing a particulate dispensing device as described above. The method also includes pressing the piston downwardly into engagement with the fitting and pressing the rod downwardly with the top lid such that the stopper of the rod engages the plurality of securement tabs and moves the securement tabs radially outwardly into engagement with the annular recess of the piston to secure the piston in place axially and to hold the spring in place in its biased state. The method also includes removing the top lid to free the rod to permit movement of the stopper of the rod out of alignment with the securement tabs to remove the securement tabs from the annular recess to permit the piston to slide axially along the rod in response to unloading of the spring and to project the confetti from the top end of the tube.

The subject particulate dispensing device and associated method provide a simple, compact and inexpensive arrangement for providing an exciting particulate dispensing effect to an unsuspecting user.

DRAWINGS

The drawings described herein are for illustrative purposes only of selected embodiments and not all possible implementations thereof such that the drawings are not intended to limit the scope of the present disclosure.

DETAILED DESCRIPTION OF THE EXAMPLE EMBODIMENTS

Example embodiments of a particulate dispensing device and associated methods embodying the teachings of the present disclosure will now be described more fully with reference to the accompanying drawings. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that the example embodiments may be embodied in many different forms that may be combined in various ways, and that neither should be construed to limit the scope of the disclosure. In some example embodiments, well-known processes, well-known device structures, and well-known technologies are not described in detail.

More particularly, referring to the figures, wherein like numerals indicate corresponding parts throughout the several views, embodiments of a particulate dispensing device 10 are provided. According to the example embodiment, the particulate 12 is a confetti but other types of particulate could be used. Generally, the particulate dispensing device 10 is used to shower an unsuspecting user with a particulate 12 such as confetti in response to removing a top lid 74 of the device. The device 10 generally has the appearance of a generic tube (e.g. a tube for containing a package), and thus does not lead the user to knowing that the device 10 is a prank device.

Figure 1:
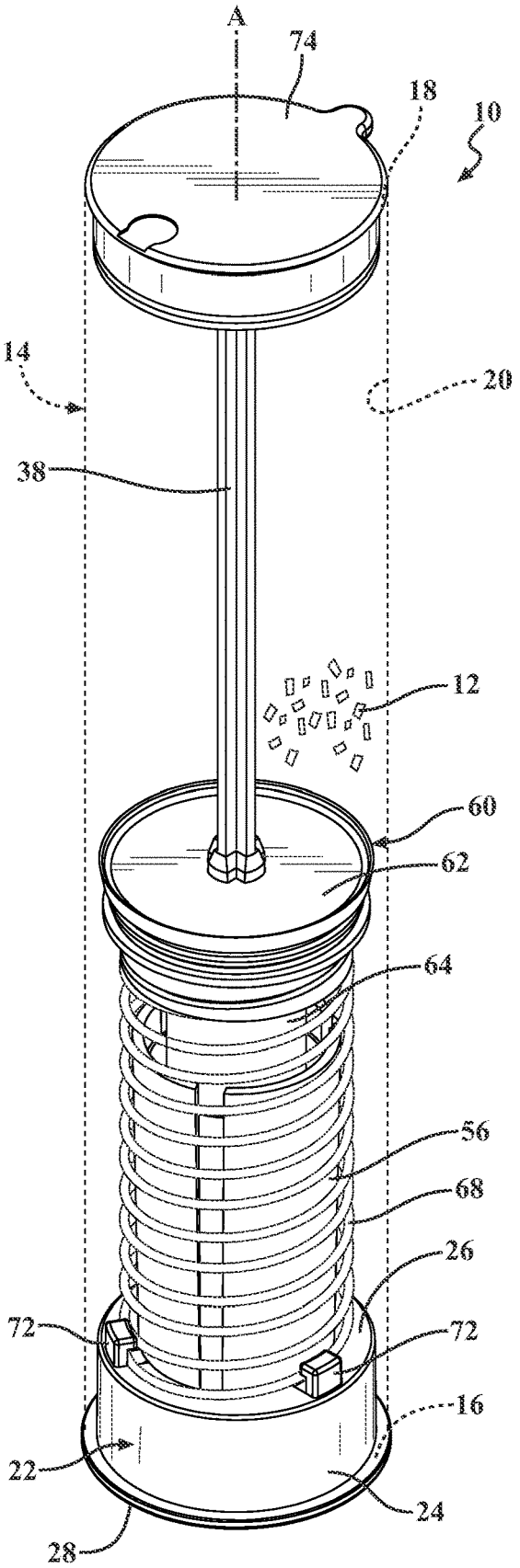
FIG. 1 is a perspective view of a particulate dispensing device according to an aspect of the disclosure.
Figure 2:
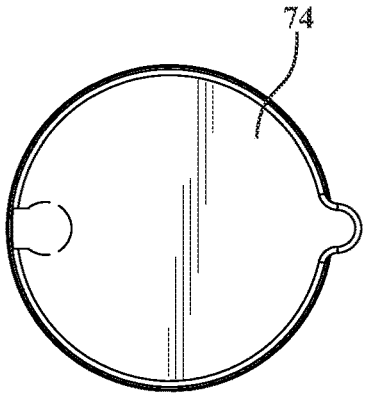
FIG. 2 is a top view of the particulate dispensing device.
Figure 3:
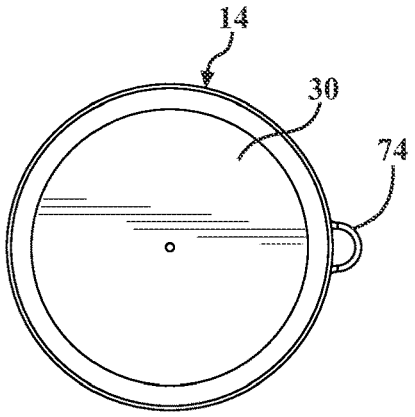
FIG. 3 is a bottom view of the particulate dispensing device.

As shown in FIG. 1, the particulate dispensing device 10 includes an elongated tube 14 that extends along an axis A between a bottom end 16 and a top end 18. The tube 14 defines a bore 20 that extends axially between the bottom and top ends 16, 18.

Figure 4:
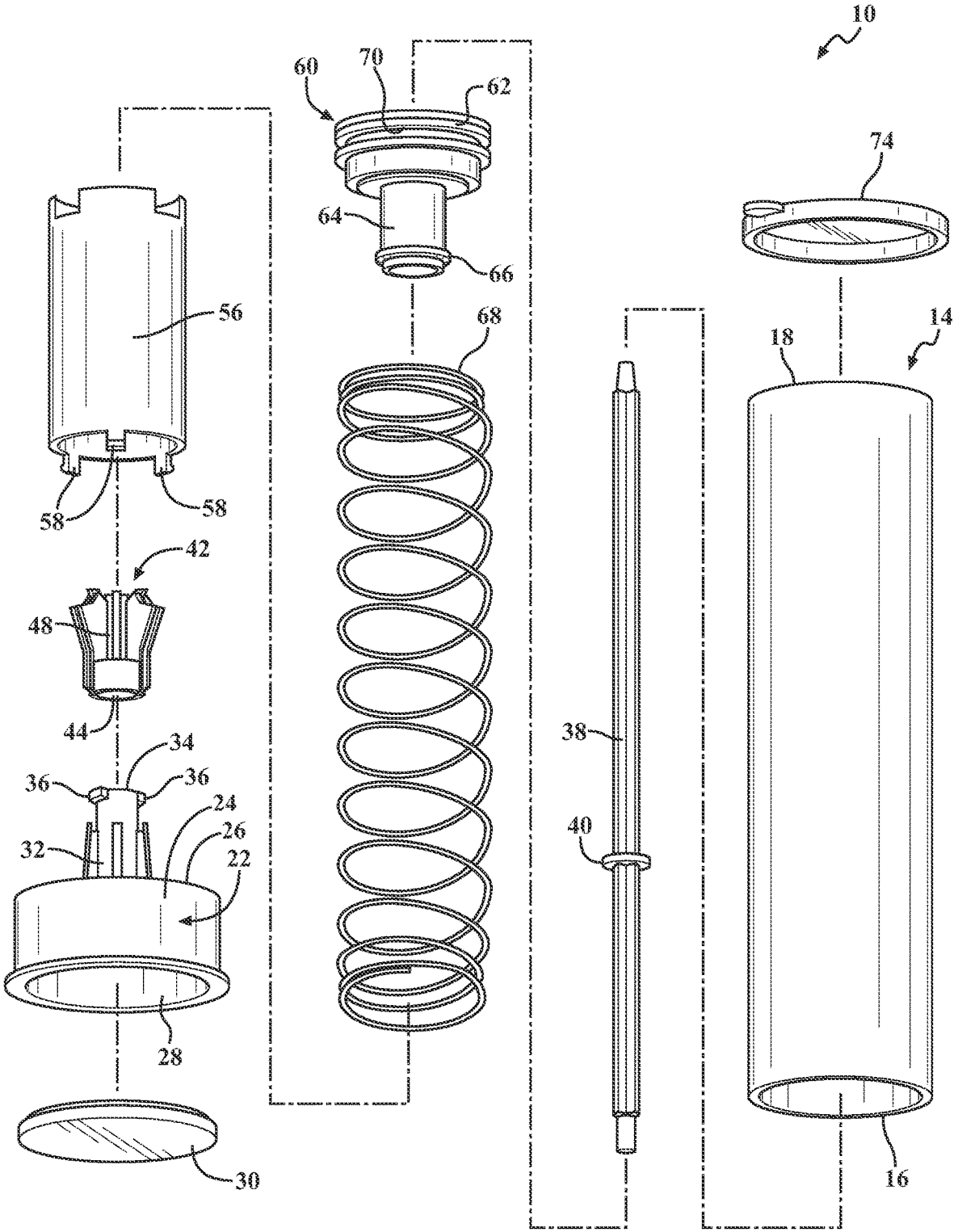
FIG. 4 is a front, exploded view of the particulate dispensing device.
Figure 6:
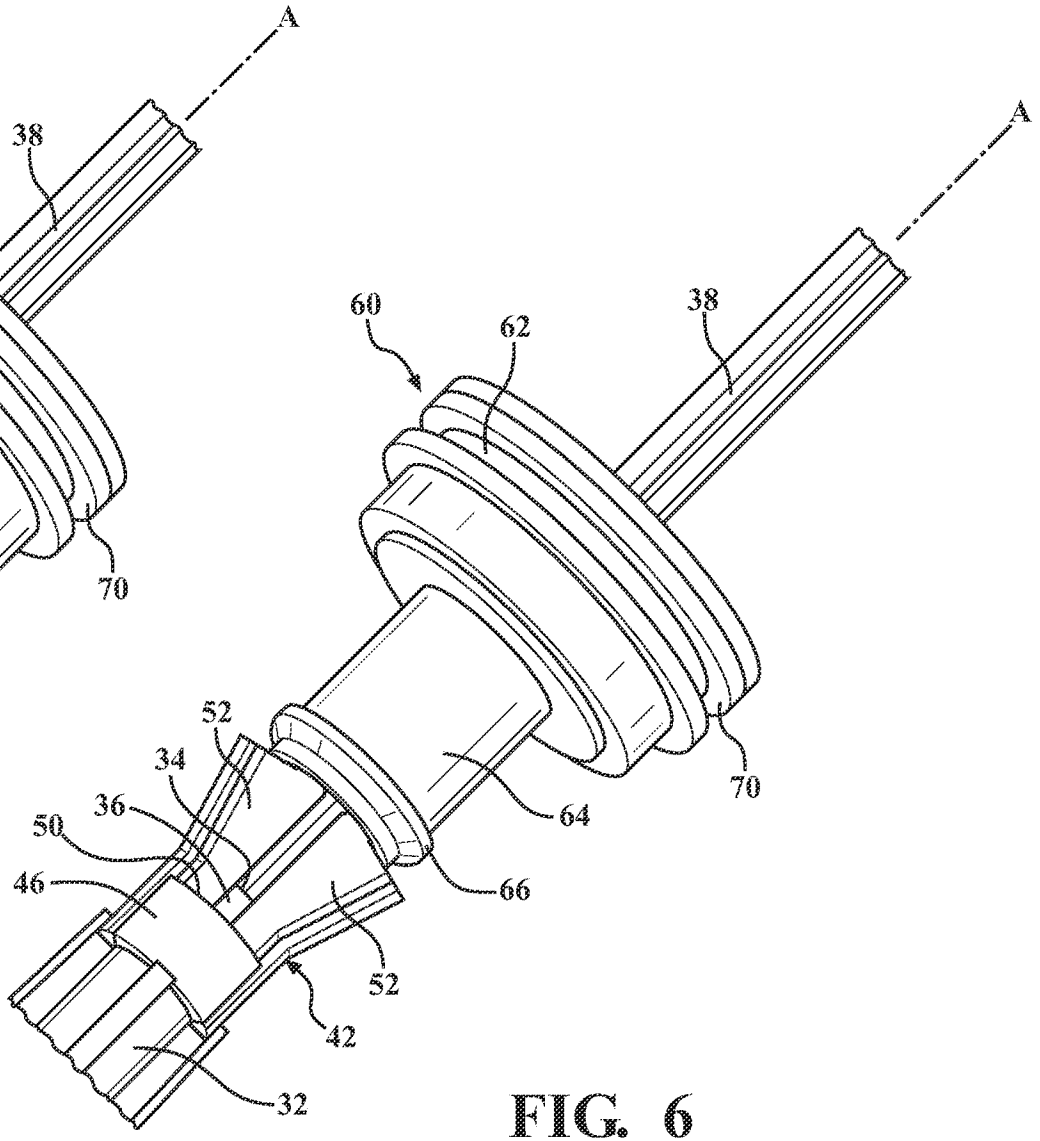
FIG. 6 is a magnified perspective view of a connection of the fitting to the piston while in a stored position.
Figure 5:
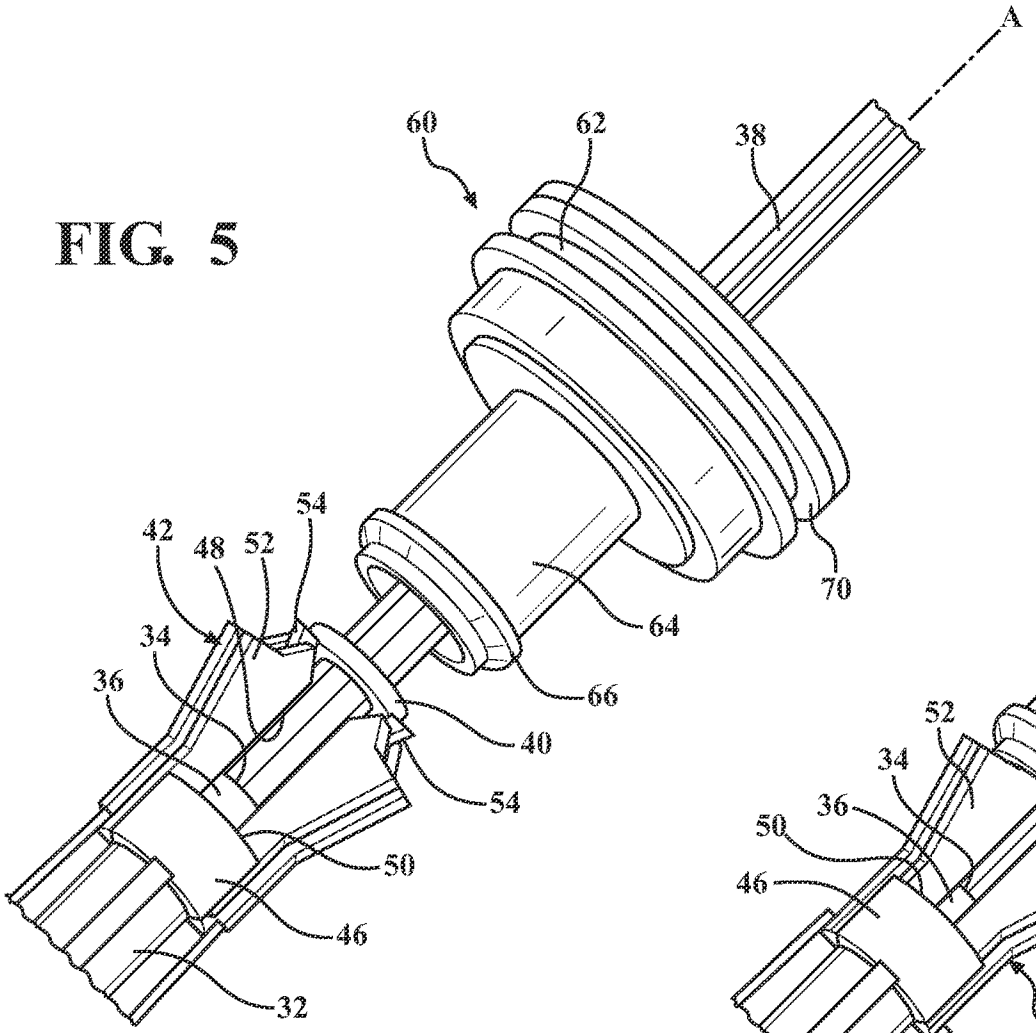
FIG. 5 is a magnified perspective view of a fitting, rod and piston of the particulate dispensing device.

A base 22 is received by the bottom end 16 of the tube 14. The base 22 has a sleeve portion 24 that is received by the bottom end 16 of the tube 14 in the bore 20 and terminates at a top surface 26 inside the bore 20. The base 22 further has an open bottom surface 28 that removeably receives a disc-shaped bottom cover 30. As best shown in FIGS. 4-6, the base 22 further includes a projection 32 that extends axially from the top surface 26 and terminates at a distal end 34. A plurality of nubs 36 extend radially outwardly from the projection 32 adjacent to the distal end 34 of the projection 32. The nubs 36 are positioned in circumferentially spaced relationship with one another.

A first slot (not shown) extends axially through the base 22. The first slot has a first cross-sectional shape. A rod 38 is axially moveably received by the first slot of the base 22. The rod 38 has the first cross-sectional shape such that the rod 38 is axially moveable within the first slot but not rotatable relative to the first slot. According to the preferred embodiment, the cross-sectional shape is a "plus sign" shape, but other shapes could be used. The rod 38 has a stopper 40 at an axially central location of the rod 38. According to the preferred embodiment, the stopper 40 tapers radially inwardly as it extends axially downwardly in a generally frustoconical shape.

The base further includes a fitting 42 that is coupled to the projection 32. More particularly, as best shown in FIGS. 4-6, the fitting 42 defines an axially extending passage 44 that receives a top of the projection 32. A sidewall 46 of the fitting 42 defines a plurality of axially extending slots 48 that each terminate at a stopping end 50. Each of the slots 48 are configured to receive one of the nubs 36 of the projection 32 to connect the fitting 42 to the projection 32. This permits the fitting to be connected to the projection 32 via a snap-fit type connection. As shown, the rod 38 further extends axially through the slot of the fitting 42 with the stopper 40 of the rod 38 positioned above the fitting 42.

As best shown in FIGS. 5-6, a plurality of wings 52 extend outwardly from the fitting 42 adjacent to a top of the fitting 42 in circumferentially spaced relationship with one another. Furthermore, as best shown in FIG. 5, a plurality of securement tabs 54 are each moveably connected between a pair of the wings 52. The securement tabs 54 are each radially moveable relative to the wings 52. Each of the securement tabs 54 has a tapered shape which tapers radially inwardly as the securement tab 54 extends downwardly.

As best shown in FIGS. 1 and 4, a generally tube-shaped cover 56 is coupled to the top surface 26 of the base 22 and disposed about the projection 32 and fitting 42. The cover 56 may be connected to the base 22 via an arrangement of fingers 58 on the cover 56 and associated slots 48 on the base 22.

A piston 60 is slideable along the rod 38 in the bore 20 of the tube 14. The piston 60 has a disc-shaped top portion 62 with an outer diameter that is approximately the same as an inner diameter of the bore 20 of the tube 14 such that it sealingly engages an inner wall of the tube 14 as it axially moves within the tube 14. The piston 60 further has a tube-shaped lower portion 64 that extends dowardly from the top portion 62. An inner wall of the lower portion 62 of the piston 60 defines an annular recess 66 that projects radially outwardly.

A spring 68 is located inside the bore 20 of the tube 14 and extends between the top surface 26 of the base 22 and a bottom surface 70 of the top portion 62 of the piston 60. As shown in FIG. 1, a plurality of clips 72 connect the spring 68 to the top surface 26 of the base 22. The spring 68 is disposed about the projection 32, the fitting 42 and the cover 56. The spring 68 biases the piston 60 upwardly.

Figure 7:
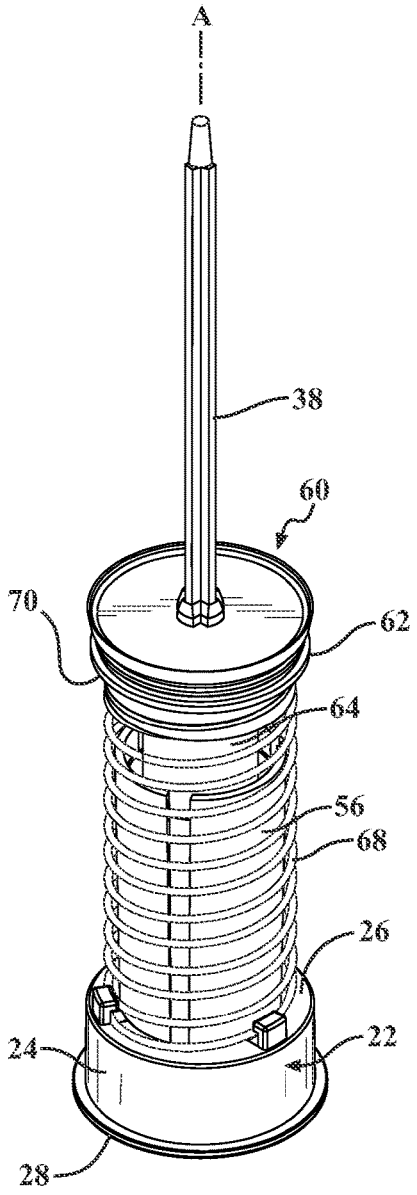
FIG. 7 is a perspective view illustrating a piston of the particulate dispensing device in the stored position.
Figure 8:
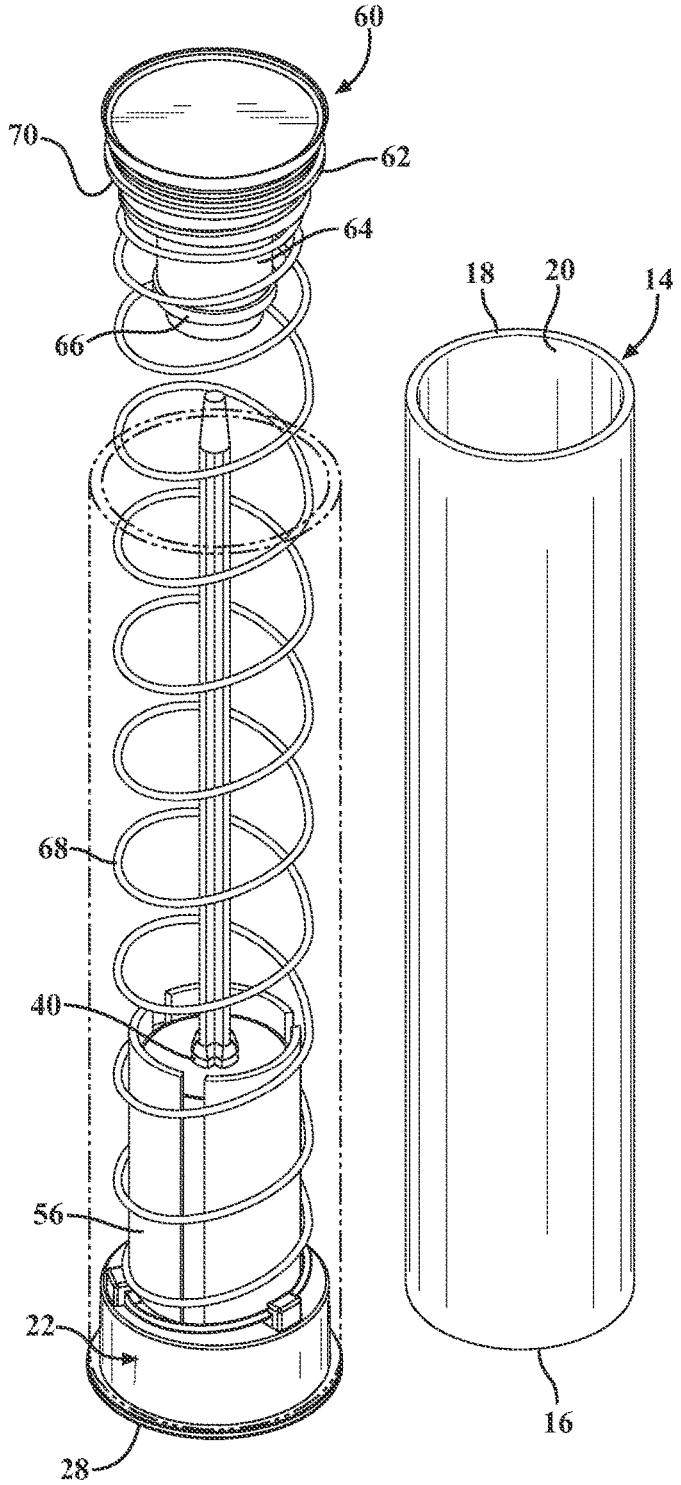
FIG. 8 is a perspective view illustrating the piston of the particulate dispensing device in a released position.

The piston 60 is axially moveable between a stored position (e.g. FIGS. 1 and 7) and an extended position (e.g., FIG. 8) in which the piston 60 projects the particulate 12 from the top end 18 of the tube 14. As shown in FIG. 1, in the stored position, a top lid 74 closes the top end 18 of the tube 14 and contains the rod 38 in a position in which the rod 38 is pressed downwardly toward the base 22. As shown in FIG. 6, while in the stored position, the lower portion 62 of the piston 60 presses downwardly against the wings 52 of the fitting 42 and the piston 60 compresses the spring 68. Furthermore, while in the stored position, the stopper 40 of the rod 38 engages the plurality of securement tabs 54 and moves the securement tabs 54 radially outwardly into engagement with an inside of the annular recess 66 of the piston 60. More particularly, because of the tapered shape of the securement tabs 54, downward axial movement of the stopper 40 against the securement tabs 54 causes radial outward movement of the securement tabs into the annular recess 66 of the piston 60. While in this arrangement, the securement tabs 54 secure the piston 60 in place axially, which thereby holds the spring 68 in place in its biased state. While the piston 60 is in this state, the particulate 12 is located in the tube 14 above the piston 60. In this state, the piston 60 is spring-loaded and ready to launch in response to movement of the rod 38 and associated stopper 40.

During use, the top lid 74 is removed from the tube 14, which permits axial movement of the rod 38 to permit movement of the stopper 40 of the rod 38 out of alignment with the securement tabs 54 to permit the piston 60 to slide axially along the rod 38 in response to unloading of the spring 68. This causes the particulate 12 to be sprayed out of the tube 14 with the piston 60, potentially at the unsuspecting user.

Figure 9:
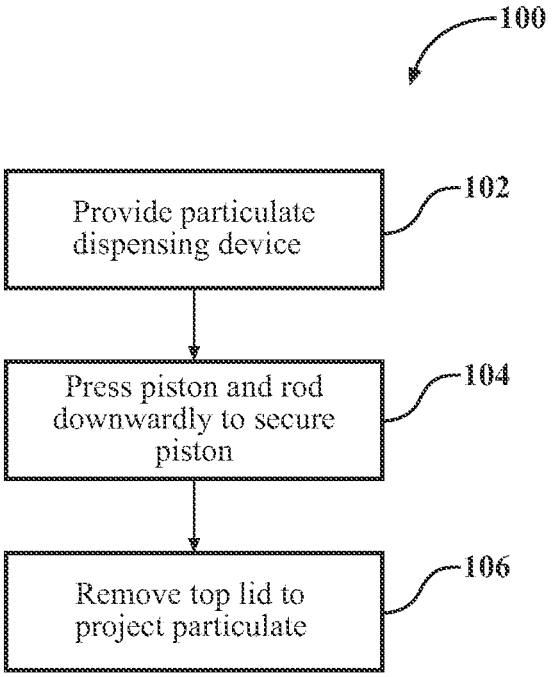
FIG. 9 is a flow diagram illustrating a method of using a particulate dispensing device.

FIG. 9 presents a method 100 of using the particulate dispensing device 10. The method includes 102 providing a particulate dispensing device 10, which may be constructed in accordance with the above. The method continues with 104 pressing the piston 60 downwardly into engagement with the fitting 42 and pressing the rod 38 downwardly with the top lid 74 such that the stopper 40 of the rod 38 engages the plurality of securement tabs 54 and moves the securement tabs 54 radially outwardly into engagement with the annular recess 66 of the piston 60 to secure the piston 60 in place axially and to hold the spring 68 in place in its biased state. The method continues with 106 removing the top lid 74 to free the rod 38 to permit movement of the stopper 40 of the rod 38 out of alignment with the securement tabs 54 to remove the securement tabs 54 from the annular recess 66 to permit the piston 60 to slide axially along the rod 38 in response to unloading of the spring 68 and to project the particulate 12 from the top end 18 of the tube 14.

The subject particulate dispensing device 10 and associated method provide a simple, compact and inexpensive arrangement for providing an exciting particulate dispensing effect to an unsuspecting user. A majority of the components of the subject particulate dispensing device 10 are simple in design and may be made of plastics through simple and inexpensive methods such as 3d printing.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in that particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or later, or intervening element or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to described various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A particulate dispensing device, comprising:

an elongated tube extending along an axis between a bottom end and a top end and defining a bore along the axis;

a top lid removeably closing the top end of the tube;

a base in the bore of the tube adjacent to the bottom end;

a rod axially moveable in the tube, the rod extending between a first end and a second end and extending into the base;

the rod defining an annular stopper axially between the first and second ends of the rod, and extending radially outwardly;

a piston slideable along the rod in the bore of the tube;

the piston having a lower end being tube-shaped and having an inner wall defining an annular recess extending radially outwardly into the inner wall;

a plurality of securement tabs coupled to the base in circumferentially spaced relationship with one another about the axis, the securement tabs each radially moveable in response to engagement by the annular stopper of the rod between a locked position in which the securement tabs are radially received in the annular recess of the piston to fix the piston in place, and an unlocked position in which the securement tabs are radially out of alignment with the annular recess;

a spring inside the bore of the tube and biasing the piston upwardly;

in a stored position, the rod pressed downwardly with the top lid such that the stopper of the rod engages the plurality of securement tabs and moves the securement tabs in the locked position to secure the piston in place axially while biased upwardly by the spring;

the top lid removable to a released position to free the rod to permit movement of the stopper of the rod out of alignment with the securement tabs to move the securement tabs to the unlocked position to permit the piston to slide axially upwardly along the rod in response to unloading of the spring; and a particulate contained in the tube between the piston and the top lid for being emitted from the tube in response to removal of the top lid and axial movement of the piston.

2. The particulate dispensing device as set forth in claim 1, wherein the base includes a fitting including an annular sidewall and a plurality of wings extending outwardly from the sidewall in circumferentially spaced relationship with one another, and wherein the piston axially engages the wings of the fitting when the piston is in the stored position.

3. The particulate dispensing device as set forth in claim 2, wherein each of the securement tabs are positioned circumferentially between, and radially moveable relative to a pair of the wings.

4. A method for operating a particulate dispensing device, comprising:

providing a particulate dispensing device including an elongated tube extending along an axis between a bottom end and a top end and defining a bore along the axis, a top lid removeably closing the top end of the tube, a base in the bore of the tube adjacent to the bottom end, a rod axially moveable in the tube and extending between a first end and a second end and extending into the base, the rod defining an annular stopper axially between the first and second ends of the rod and extending radially outwardly, a plurality of securement tabs coupled to the base in circumferentially spaced relationship with one another about the axis, the securement tabs each radially moveable relative to the base, a piston slideable along the rod in the bore of the tube, the piston having a lower end being tube-shaped and having an inner wall defining an annular recess extending radially outwardly into the inner wall, a spring inside the bore of the tube and biasing the piston upwardly, and a particulate in the tube above the piston;

pressing the piston downwardly into engagement with the base and pressing the rod downwardly with the top lid such that the stopper of the rod engages the plurality of securement tabs and moves the securement tabs radially outwardly into a locked position in which the securement tabs are radially received in the annular recess of the piston to secure the piston in place axially while biased upwardly by the spring; and removing the top lid to free the rod to permit movement of the stopper of the rod out of axial alignment with the securement tabs to remove the securement tabs from the annular recess in an unlocked position to permit the piston to slide axially along the rod in response to unloading of the spring and to project the confetti from the top end of the tube.

5. The method as set forth in claim 4, wherein the base includes a fitting including an annular sidewall and a plurality of wings extending outwardly from the sidewall in circumferentially spaced relationship with one another, and wherein the piston axially engages the wings of the fitting when the piston is in the stored position.

6. The method as set forth in claim 5, wherein each of the securement tabs are positioned circumferentially between and radially moveable relative to a pair of the wings.

* * * * *